United States Patent [19]

Costa et al.

[11] Patent Number: 4,778,290

[45] Date of Patent: Oct. 18, 1988

[54] PRINTER FOR PRINTING OF A FULL LINE IN SEVERAL COLORS BY INTERCHANGEABLE RIBBON CARTRIDGES

[75] Inventors: Jorge Costa; Adrien Zahner; Felix Zurita, all of Yverdon, Switzerland

[73] Assignee: Hermes Precisa International SA, Yverdon, Switzerland

[21] Appl. No.: 796,285

[22] Filed: Nov. 8, 1985

[30] Foreign Application Priority Data

Nov. 11, 1984 [CH] Switzerland ..... 5586/84

[51] Int. Cl.[4] ..... B41J 32/00

[52] U.S. Cl. ..... 400/208; 400/120; 400/206; 400/214; 400/240.4

[58] Field of Search ..... 400/120, 194, 195, 196, 400/196.1, 206, 206.3, 206.4, 207, 208, 208.1, 214, 216.1, 224.2, 240, 240.3, 240.4; 101/336; 346/76 PH

[56] References Cited

U.S. PATENT DOCUMENTS

| | | | |
|---|---|---|---|
| 3,904,017 | 9/1975 | Frechette | 400/208 X |
| 3,927,747 | 12/1975 | Wolowitz | 400/214 X |
| 3,980,171 | 9/1976 | Frechette | 400/214 X |
| 3,995,731 | 12/1976 | Miller et al. | 400/208.1 X |
| 4,384,797 | 5/1983 | Anderson et al. | 400/120 X |
| 4,447,818 | 5/1984 | Kurata et al. | 400/120 X |
| 4,469,459 | 9/1984 | Trezise et al. | 400/208 X |
| 4,504,160 | 3/1985 | Payne et al. | 400/208 |
| 4,534,666 | 8/1985 | Watanabe | 400/207 |
| 4,553,861 | 11/1985 | Lendl | 400/120 |
| 4,564,303 | 1/1986 | Rosenberg et al. | 400/206.3 X |

FOREIGN PATENT DOCUMENTS

| | | | |
|---|---|---|---|
| 0086661 | 8/1983 | European Pat. Off. . | |
| 2705127 | 10/1977 | Fed. Rep. of Germany | 400/196.1 |
| 3305491 | 8/1983 | Fed. Rep. of Germany . | |
| 0124687 | 7/1983 | Japan | 400/206 |
| 0171986 | 10/1983 | Japan | 400/208 |
| 0215888 | 12/1984 | Japan | 400/208 |
| 0004089 | 1/1985 | Japan | 400/240.4 |
| 8400925 | 3/1984 | PCT Int'l Appl. | 400/240.4 |

OTHER PUBLICATIONS

IBM Technical Disclosure Bulletin, "Multicolor Matrix Impact Printer", Meier, vol. 21, No. 11, Apr. 1979, pp. 4448–4451.

IBM Technical Disclosure Bulletin, "Individual Motion Drive For Color Band Ribbons", Humphreys, vol. 27, No. 8, Jan. 1985, p. 5018.

IBM Technical Disclosure Bulletin", Tape Insertion and Leader Block Attachment", vol. 28, No. 9, Feb. 1986, pp. 4130–4131.

*Primary Examiner*—Ernest T. Wright, Jr.

*Attorney, Agent, or Firm*—Gifford, Groh, VanOphem, Sheridan, Sprinkle and Dolgorukov

[57] ABSTRACT

A printer having a printing head provided with a plurality of printing elements disposed substantially along a line, a cylinder supporting a print sheet such as a sheet of paper held by an edge clamp and an ink ribbon changer. Four ink ribbons, for example, are contained each in a cartridge removably attached to a support and indexing mechanism. The support and indexing mechanism of ink ribbons and providing an accurate multicolor printing.

8 Claims, 3 Drawing Sheets

PRINTER FOR PRINTING OF A FULL LINE IN SEVERAL COLORS BY INTERCHANGEABLE RIBBON CARTRIDGES

BACKGROUND OF THE INVENTION

The present invention relates to a multi-color printer for simultaneously printing different colors on a full line.

Multi-color printers are known which generally use a thermal printing head, as disclosed in European patent application No. 86 661.

In order to effectuate multi-color printing, line by line, known printers are generally provided with several printing heads disposed one after the other and each provided with an ink ribbon of a different color. Such printers are disclosed, inter alia, for example in U.S. Pat. No. 4,447,818 and in German published application DE-OS No. 3305491, and comprise a transport mechanism for displacing the paper from a printing section to the next. Multi-color printers of that type are expensive to manufacture in view of the high cost of a linear thermo printing head. In addition, accurate superimposition of the diverse colors printed is difficult to achieve and requires particularly severe structural specifications with respect to the paper transport mechanism.

Multi-color printers are also known which are capable of printing line by line with a single printing head and an ink ribbon having portions of different colors arranged one after the other. Those printers, referred to as "harlequin" types, are structurally simpler, but lead however to great waste of ink ribbons, with the result that they are costly to operate.

SUMMARY OF THE INVENTION

The principal object of the invention is to remedy the inconveniences of the prior art by providing an accurate multi-color printer, while providing a substantial reduction of ink ribbon consumption. A printer according to the invention is characterized in that it is provided with at least another ink ribbon and a changer mechanism for exchanging and placing in operation either one or the other of the ink ribbons in registry with an appropriate printing position. The printer of the invention provides an arrangement for simultaneous printing of a full line and has a print transport member on which a sheet or a ribbon of paper, or any other material which it is desired to print, is applied during printing, a printing head provided with a plurality of printing elements which are disposed substantially along a line, an ink ribbon of a width corresponding substantially to the width of the printing head and a transport or feed mechanism capable of displacing the paper along a direction perpendicular to the line, the ink ribbon being, in its printing position, inserted between the paper and the printing elements and displaced along that direction perpendicular to the line.

A better understanding of the invention will be obtained by those skilled in the art upon reading the following detailed description of the best mode contemplated at the present for practicing the invention in conjunction with the annexed drawing representing schematically, and for illustrative purpose only, alternate embodiments of the invention. In the drawing:

DETAILED DESCRIPTION OF THE PREFERRED EMBODIMENTS

Figure 1:
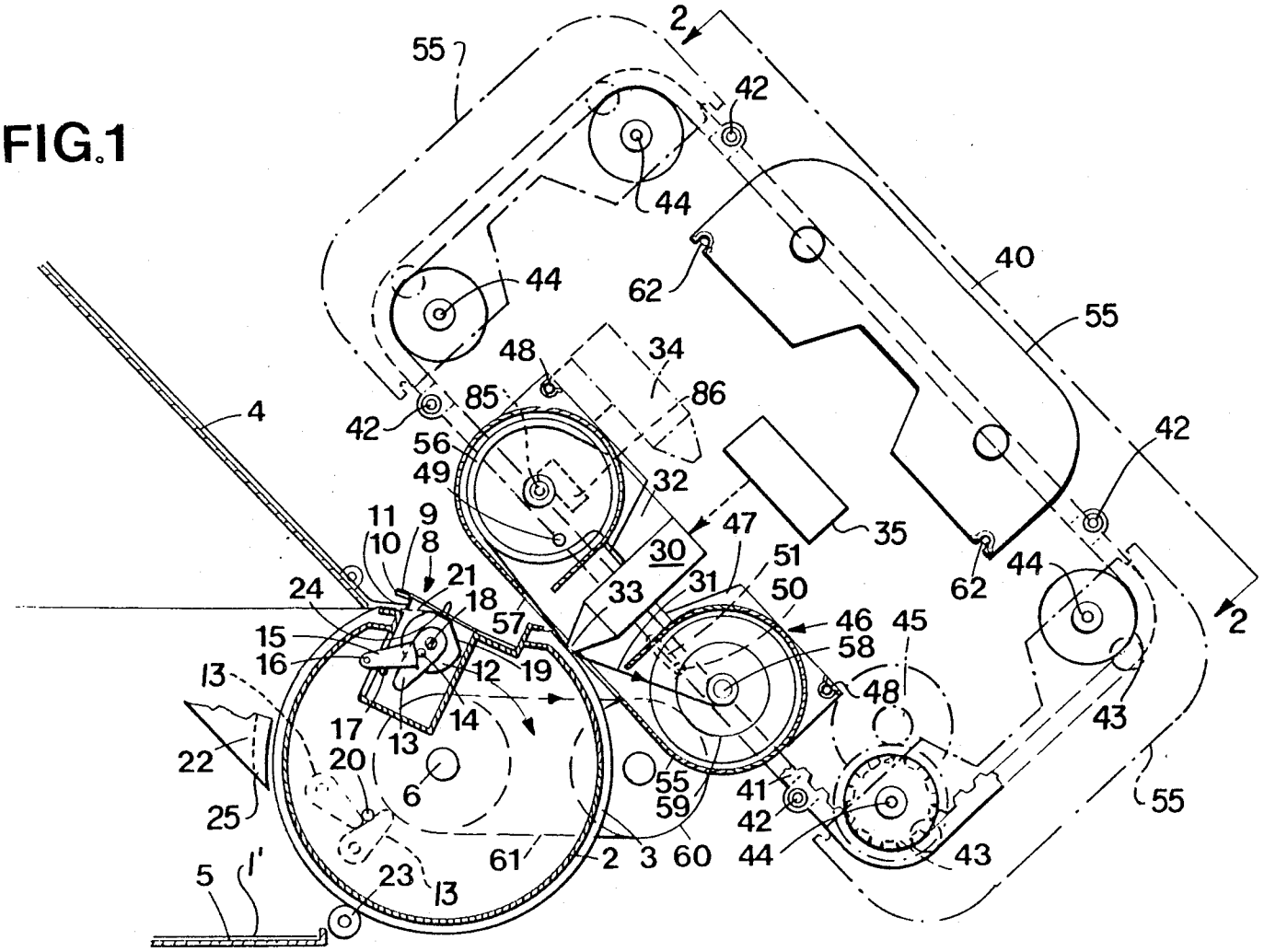
FIG. 1 is a schematic transverse sectional view of a first example of structure according to the invention.
Figure 2:
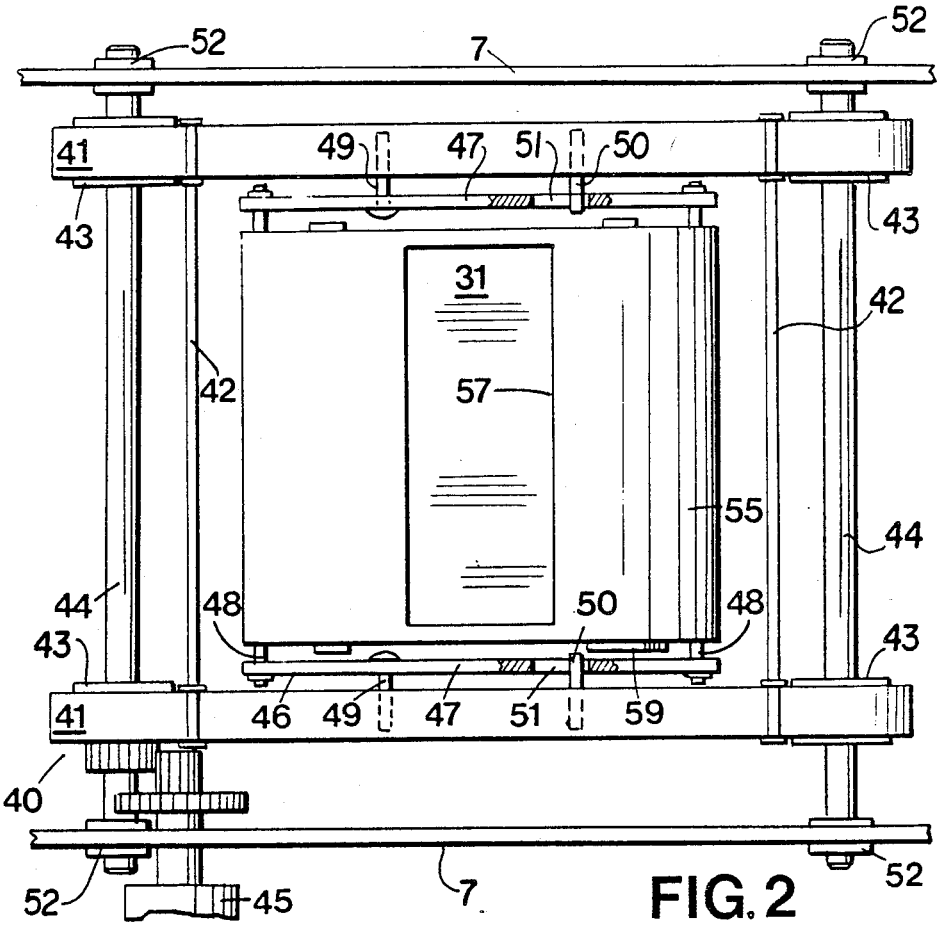
FIG. 2 is a view from line 2—2 of FIG. 1.

Referring to the drawing, and more particularly to FIGS. 1 and 2, a printer according to the invention comprises a print support member in the form of a drum 2, for example in the form of an aluminum extrustion, provided with a coating 3 of elastomeric material. Sheets 1 of paper to be printed are supplied to the printer along an inclined chute 4, and the printed sheets 1 are stacked in a receptacle 5 after printing. The drum 2 is rotatably supported by a shaft 6 from the frame 7 of the printer, and includes a paper pressing or clamp mechanism 8. The paper clamp mechanism 8 comprises a resiliently flexible metallic plate or blade 9 in the form of a comb attached at one of its lateral edges along its whole length to the drum 2. The teeth of the comb are provided with support members 10 flexibly pulled against the drum 2, and they permit to hold the edge of the sheet 1 of paper on the drum 2. They are also provided with abutments 11 acting as a stop for holding the sheet 1 of paper in an accurate position when introduced into the printer. The opening and closing of the flexible blade 9 is controlled by a cam 12 mounted on a pivotable shaft 18 attached to the drum 2. The cam 12 carries a control finger 13 provided with a projection 14 capable of co-operating with an abutment 15 pivotally supported around a shaft 16 attached to the frame 7.

A rod 17 defines a home position for the abutment 15. The printer further comprises a control bar 20 which is retractable relative to the frame 7 and which controls the opening of the paper clamp mechanism 8, after a sheet 1 of paper has been printed, in co-operation with the finger 13, as shown in dashed lines at FIG. 1. In order to prevent that a sheet 1 of paper remains adhered to the surface of the drum 2 after printing, the paper clamp mechanism 8 is also provided with a second flexible plate 21 shaped as a comb and having teeth disposed in the spaces between the abutments 11. Affixed on one side to the drum 2, together with the blade 9, the blade 21 is applied on its other side in a position permitting to introduce a sheet 1 against the drum 2, as illustrated at FIG. 1. When the control finger 13 passes over the control bar 20, both the flexible blades 9 and 21 are lifted in order to free the printed sheet 1 from being applied against the drum 2. After the finger 13 has passed beyond the bar 20, the cam 12, under the influence of the biasing force of the two metallic blades 9 and 21, is returned in reverse by a few degrees in a counterclockwise direction to remain in its second predetermined home position determined by a planar surface 24.

In addition, the printer includes a guide screen 22 having slots 25 through which are passed the lifted teeth of the metallic blade 9. The guide screen 22 directs the sheet 1' of paper separated from the drum 2 towards the receptacle 5. A roller 23 causes the sheet 1' to be directed towards the receptacle 5 when it is freed from the paper clamp mechanism 8.

The printer has a printing head 30 provided with a predetermined number of heating elements 33 linearly disposed. Each heating element 33 is connected to a control unit 35, which controls the flow of electrical current through some of the elements 33 at a given time, which causes a heating of the selected elements 33 and a thermal transfer of ink from an ink ribbon 31 to the paper sheet 1 to be printed. The printing head 30 is mounted on arms 32 pivotable about a shaft 85 and controlled by a motor 86, and arranged to apply the heating elements 33 with a predetermined pressure against the ink ribbon 31, and to retract the printing head 30 such as shown in dashed lines at 34. The printer has a ribbon changer 40 for changing and positioning one or the other of a plurality of ink ribbons 31 in a printing position. The changer 40 comprises a conveyor formed by a pair of timing belts 41 interconnected by four rods 42 to ensure that the belts 41 are displaced along parallel paths. The belts 41 are supported over four rollers 43 having each toothed cogs on its periphery, and supported by shafts 44 journalled by means of bearings 52 through the frame 7. One of the shafts 44 is driven by a stepping motor 45. Four mounting means 46, each for one of four cartridges 55 are disposed on the two belts 41 such as to define a substantially rectangular changer circuit. The mounting means 46 comprise a pair of lateral plates 47, FIG. 2, interconnected by tie rods 48. Each of the plates 47 is held from one of the belts 41 by two pins 49 and 50. The pin 49 is passed through a hole in the plate 47 and acts as a pivot axis, while the other pin 50 is arranged to slide in a slot 51 in the plate 47 such as to enable the plate 47 to pass over the corner of the rectangular circuit.

Figure 3:
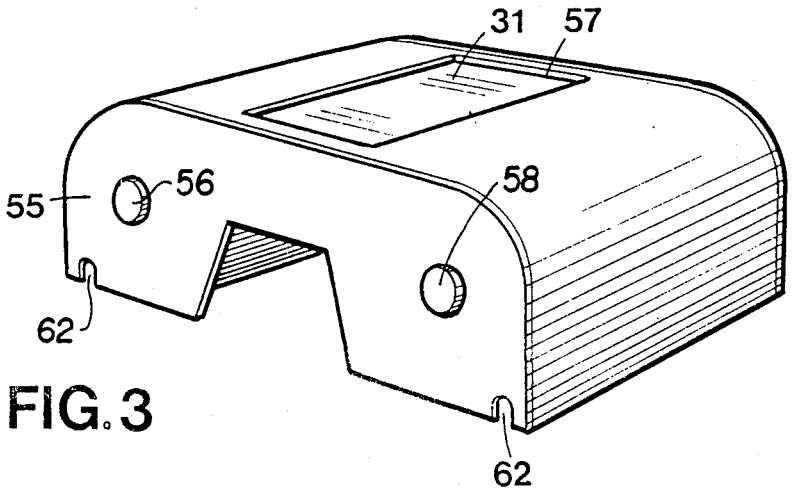
FIG. 3 is a perspective view of an ink ribbon cartridge.

The printer is designed for multi-color printing by four colors, and is provided with four ink ribbons 31 for printing in black, yellow, cyan and magenta. The ink ribbons 31 are contained each in one of four cartridges 55, an example of which is illustrated at FIG. 3. In each cartridge 55, the ink ribbon 31 is unwound from a supply reel 56, travels behind a rectangular opening or window 57 and is wound around a take-up reel 58. The take-up reel 58 has a knurled wheel 59 frictionally engageable, when the cartridge 55 is in a printing position, with a drive wheel 60, in turn driven by the drum 2 through a belt 61. Each of the cartridges 55, made of synthetic resin, is provided with appropriate retaining slots 62 adapted to frictionally engage the tie rods 48 and permitting to install each cartridge 55 on the mounting means 46.

The printer operates in the following manner. At rest, the printing head 30 is in the position 34 illustrated in dashed lines at FIG. 1 and the paper clamp 8 is open. Following a command signal for introducing a sheet 1 of paper, a sheet 1 is supplied along the inclined chute 4 and is stopped by the abutment 11 on the drum 2 in an accurate position. The drum 2 is then rotated 9° in reverse in a counterclockwise direction. The projection 14 being engaged with the pivotable abutment arm 15, the cam 12 is rotated around its shaft 18 until its flat face 19 is in engagement with the flexible blade 9 which pinches the edge of the paper sheet 1 between the pressure edge support member 10 and the drum 2. The drum 2 then rotates in a clockwise direction, as shown by the arrow in FIG. 1, to position the paper sheet 1 in a printing position.

Following a printing command for a selected color, the stepping motor 45 is energized to displace the cartridge 55 containing the appropriate ink ribbon 31 to its printing position. The printing head 30 is thereafter pivoted to be introduced into the center of the cartridge 55 and positioned such that the heating elements 33 engage the ink ribbon 31 and applies the ink ribbon 31 through the window 57 at a predetermined pressure against the paper sheet 1 on the surface of the drum 2. Printing can take place line by line by simultaneous heating of selected ones of the heating elements 33 for each line at a predetermined moment. When it is desired not to print any point of a line, the printing head 30 is withdrawn a few milimeters away from the drum 2 such that the ink ribbon 31 is no longer applied against the paper sheet 1. The drum 2 can then rotate freely without driving the ink ribbon 31. For that purpose, the frictional force for driving the take-up reel knurled wheel 59 by the drive wheel 60 is chosen such that the ink ribbon 31 is fed when the printing head 30 applies the ribbon 31 against the paper sheet 1 on the drum 2 and when the latter is rotated in the direction of the arrow. The frictional force is however too weak to feed the ribbon 31 when the latter is not applied against the paper sheet 1 and helped in its feeding motion by the rotation of the drum 2.

During printing, the control bar 20 is retracted such as to not control the opening of the paper clamp 8 if a new color is selected. The projection 14 lifts the abutment arm 15 when passing by without changing the position of the cam 12. After a complete revolution of the drum 2 has been effected, the printing head 30 is retracted and the stepping motor 45 of the ink ribbon changer 40 is energized for placing, if so required, another cartridge-contained ink ribbon 31 in the printing position, and so on.

While the last selected color is being printed, the control bar 20 is advanced such as to co-operate with the finger 13. While passing by the control bar 20, the cam 12 is rotated and lifts first the blade 9 to free the paper sheet 1 and subsequently the ejection blade 21. The shape of the cam 12 is such that the cam 12 is reversed until it is immobilized in a second home position by its flat face 19 being placed in engagement with the flexible blade 9. In this home position, the paper clamp 8 is open, but the ejection blade 21 is engaged against the drum 2, as shown in FIG. 1. The teeth of the blade 9 having been lifted pass through the slots 25 of the guide screen 22. When the drum 2 is in the angular position illustrated at FIG. 1, another sheet 1 of paper can be fed to the drum 2 because the paper clamp 8 is open.

Figure 4:
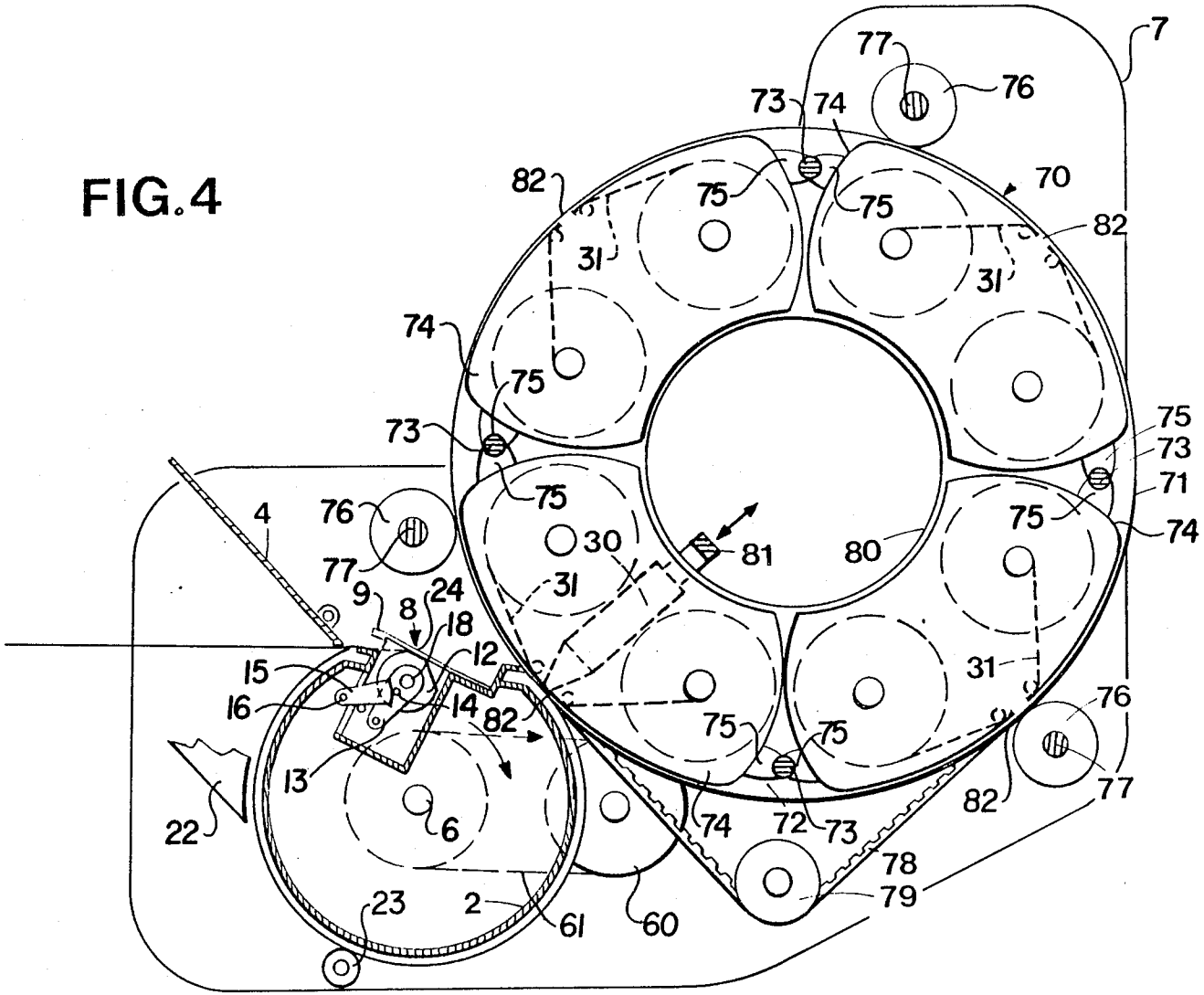
FIG. 4 is a schematic partial transverse section through a second embodiment of the invention.

The second embodiment illustrated at FIG. 4 is provided with a print support identical to the embodiment of FIGS. 1–2, but has a different ink ribbon changer as shown generally at 70. The ink ribbon changer 70 consists of a drum 71 closed at both ends by lateral disk-like circular plates 72 interconnected by four tie rods 73. Four cartridges 74, each containing an ink ribbon 31, are provided with projecting portions 75 frictionally engaged over the tie rods 73.

The two lateral end plates 72 are supported by three rollers 76 each on a shaft 77 in turn supported from the printer frame 7. A timing belt 78 drives the drum 71 from a stepping motor 79. A circular opening 80 is disposed at the center of each end plate 72 in order to clear a control arm 81 adapted to extend and retract the printing head 30. The cartridges 74 are also provided with a front opening or window 82 permitting the ink ribbon 31 to be applied against the paper sheet 1. The operation of the printer illustrated at FIG. 4 is identical to that of the printer hereinbefore described.

It will be appreciated by those skilled in the art that the specific examples of structure herein described have been given for illustrative purpose only. For example, the print support could consist of a planar slide effecting a reciprocating linear motion. Changes may be provided for a different number of ink ribbon cartridges. The printing head can be any other appropriate type of printing head, such as for example a wire matrix printing head having printing wires or needles arranged substantially in a row along a line.

Having thus described the present invention, modifications of which will be apparent to those skilled in the art, what is claimed as new is as follows:

We claim:

1. A printer for the printing of a full line, said printer comprising a sheet support member for supporting a sheet to be printed, a printing head having a plurality of printing elements disposed substantially along a line extending along the length of the printing head, an ink ribbon of a width corresponding substantially to the length of the printing head, and a transport mechanism for transporting the sheet to be printed on said sheet support member along a direction perpendicular to said line, wherein the ink ribbon is disposed in a printing position between said sheet and said printing head and is displaced along said direction perpendicular to said line and wherein said printer comprises at least a second ink ribbon and changer means for changing said ribbons and placing one or the other of said ribbons in said printing position, each of said ink ribbons being carried by a ribbon support member, said changer means comprising a conveyor for supporting each of said ribbon support members and for placing one of said ribbon support members in said printing position, said conveyor having a closed loop formed by a timing belt supported by rollers and driven by a motor, said conveyor having means for affixing each of said ribbon support members to said conveyor and wherein said printer further includes means for placing said printing head in engagement with one of said ink ribbons against said sheet support member during printing and for withdrawing said printing head from said one of said ink ribbons during displacement of said one of said ink ribbons by said conveyor.

2. The printer of claim 1 wherein each of said ribbon support members comprises a cartridge and wherein said printer further includes means mounting each of said cartridges on said conveyor.

3. The printer of claim 2 wherein said means for placing said printing head includes a shaft around which said printing head is pivoted for placement within one of said cartridges and for applying the respective ink ribbon against said sheet on said sheet support member and for withdrawing said printing head from said one said cartridges when said conveyor is energized.

4. A printer for the printing of a full line, said printer comprising a sheet support member supporting a sheet to be printed, a printing head having a plurality of printing elememts disposed substantially along a line, an ink ribbon of a width corresponding substantially to the length of the printing head, and a transport mechanism for transporting the sheet to be printed on said sheet support member along a direction perpendicular to said line, wherein the ink ribbon is disposed in a printing position between said sheet and said printing head and is displaced along said direction perpendicular to said line; said printer comprising at least a second ink ribbon and changer means for changing said ribbons and placing one or the other of said ribbons in said printing position; each of said ink ribbons being carried by a ribbon support member; said changer means comprising a conveyor for supporting each of said ink ribbon support members and for placing one of said ink ribbon support members in said printing position; said printer further includes means for placing said printing head in engagement with one of said ink ribbons against said sheet support member during printing and for withdrawing said printing head from said one of said ribbons during displacement of said one of said ink ribbons by said conveyor; each of said ribbon support members comprising a cartridge; said printer further including means for attaching each of said cartridges to said conveyor; and wherein said conveyor comprises a closed loop formed by a timing belt supported by rollers and driven by a motor with said belt including said means for attaching said cartridges thereto.

5. The printer of claim 4 wherein said timing belt comprising at least a pair of belts interconnected by tie rods for maintaining said belts parallel to each other.

6. The printer of claim 4 wherein said timing belt is supported by said rollers such as to form a substantially rectangular loop, said rectangular loop carrying said means for attaching each of said cartridges.

7. A printer for the printing of a full line, said printer comprising a sheet support member supporting a sheet to be printed, a printing head having a plurality of printing elements disposed substantially along a line, an ink ribbon of a width corresponding substantially to the length of the printing head, and a transport mechanism for transporting the sheet to be printed on said sheet support member along a direction perpendicular to said line, wherein the ink ribbon is disposed in a printing position between said sheet and said printing head and is displaced along said direction perpendicular to said line; said printer comprising at least a second ink ribbon and changer means for changing said ribbons and placing one or the other of said ribbons in said printing position; each of said ink ribbons being carried by a ribbon support member; said changer means comprising a conveyor for supporting each of said ink ribbon support members and for placing one of said ink ribbon support members in said printing position; said printer further includes means for placing said printing head in engagement with one of said ink ribbons against said sheet support member during printing and for withdrawing said printing head from said one of said ink ribbons during displacement of said one of said ink ribbons by said conveyor; each of said ribbon support members comprising a cartridge; said printer further including means mounting each of said cartridges on said conveyor; and said conveyor comprising a drum supporting said ink ribbon cartridges.

8. The printer of claim 7 wherein said drum comprises a pair of lateral end plates interconnected by tie rods, said end plates being in the form of disks supported by guide rollers provided with a center opening for passage therethrough of means for placing said printing head, said printing head being disposed within said drum.

* * * * *

UNITED STATES PATENT AND TRADEMARK OFFICE

CERTIFICATE OF CORRECTION

PATENT NO. : 4,778,290

DATED : 10/18/88

INVENTOR(S) : Jorge Costa, Adrien Zahner, Felix Zurita

It is certified that error appears in the above-identified patent and that said Letters Patent is hereby corrected as shown below:

IN THE ABSTRACT:

Line 7 after "indexing mechanism" insert --is driven by a stepping motor allowing an interchange--.

Signed and Sealed this

Eighteenth Day of July, 1989

*Attest:*

*Attesting Officer*

DONALD J. QUIGG

*Commissioner of Patents and Trademarks*